US005150785A

United States Patent [19]

Kelley et al.

[11] Patent Number: 5,150,785

[45] Date of Patent: Sep. 29, 1992

[54] STORAGE CONTAINER

[76] Inventors: Richard L. Kelley, 666 Columbia Rd., Dorchester, Mass. 02125; Thuan N. Pham, 14 Earle St., Brockton, Mass. 02401; Kevin J. Kearns, 41 Dartmouth St., Everett, Mass. 02149

[21] Appl. No.: 691,745

[22] Filed: Apr. 26, 1991

[51] Int. Cl.[5] ..... B65D 77/00; B42D 17/00; A63B 21/00; A63B 22/00

[52] U.S. Cl. ..... 206/217.0; 224/148; 281/45; 482/52

[58] Field of Search ..... 206/217; 224/148, 250, 224/42.46 R; 272/70, 69; 248/205.2, 450; 281/43, 45; 294/148, 149, 155

[56] References Cited

U.S. PATENT DOCUMENTS

| | | | |
|---|---|---|---|
| 1,075,997 | 10/1913 | Thomas | 294/149 |
| 4,555,128 | 11/1985 | White et al. | 281/45 |
| 4,754,903 | 7/1988 | Dennis | 224/148 |
| 4,988,229 | 1/1991 | Ramsey, III | 281/45 |
| 4,989,811 | 2/1991 | Millis et al. | 248/205.2 |
| 5,060,835 | 10/1991 | Payne | 224/250 |

*Primary Examiner*—Paul T. Sewell
*Assistant Examiner*—M. Denise Patterson
*Attorney, Agent, or Firm*—Joseph H. Killion

[57] ABSTRACT

An exercise machine carry-all is disclosed for use on exercise machine consoles. The apparatus includes an elasticized strap releasably disposable about the exercise machine console, and a second strap attached at the upper end to the first strap, depending down from it to a lower end. A holder is attached to the lower end of the second strap.

6 Claims, 2 Drawing Sheets

STORAGE CONTAINER

BACKGROUND OF INVENTION

Exercise Machines, such as the stair-treadmills, treadmills, and stationery bicycles are common alternatives to outdoor exercise. Exercise, then, is not subject to fluctuation in the weather, and reproducible conditions are available for the physical fitness afficianado. Most of the exercise machines include a digital computor screen console, with which the exerciser monitors his program. This program can last anywhere from thirty to ninety minutes.

These exercise machines are customarily located in Health Club and are very heavily utilized by exercisers, more so during peak hours. An exerciser may be reluctant to leave the machine to get a drink, as he may lose his turn.

Further, the exerciser may become bored with the countless repetitions in the same place on the exercising machine. Reading or listening to music is often a relief from this tedium. It is uncomfortable to hold a radio or magazine up for a long period of time.

There is then a need for a device which will attach to exercise machine consoles, which will allow an exerciser to store a bottle or can of fluid, or to clip on a radio, and still get on with the regimen.

SUMMARY OF INVENTION

My invention relates to an Exercise Machine Carry-all.

I have discovered an Exercise Machine Carry-all which is elastically disposed over the exercise machine console located on most exercise machines A strap is stretched over the exercise machine console and includes a second expansible strap stretchable between a first position releasing a book, for example, and a second position tightly holding the book against the exercise machine console. Suspended from the first strap is a holder at the downward end into which a can of soda can be placed.

Preferably but optionally my Exercise Machine Carry-all includes a section of the strap means having a dual strap, both portions of which are expansible, into which may be inserted a slippery object such as a magazine, which would slip through the ordinary strap. The dual strap section retains even a slippery object.

Preferably but optionally the straps of my Exercise Machine Carry-all includes a textured surface to increase friction between the various substances and the exercise strap means.

My invention provides numerous advantages over those devices found in the prior art. Advantages of my invention include that it disposes itself about a common media found in exercise machines, i.e. the exercise machine console.

Other advantages are that it allows the user to store beverage cans. In addition a Walkman Radio can be clipped onto the strap, and reading material can not only be held against the exercise machine console, but in the case of glossy or slippery materials such as a magazine, can be held firmly against the exercise machine console.

Further advantages of my invention are that it can be used quickly and accurately in the field and is highly reliable, portable and relatively inexpensive.

DETAILED DESCRIPTION OF THE DRAWINGS

Figure 1:
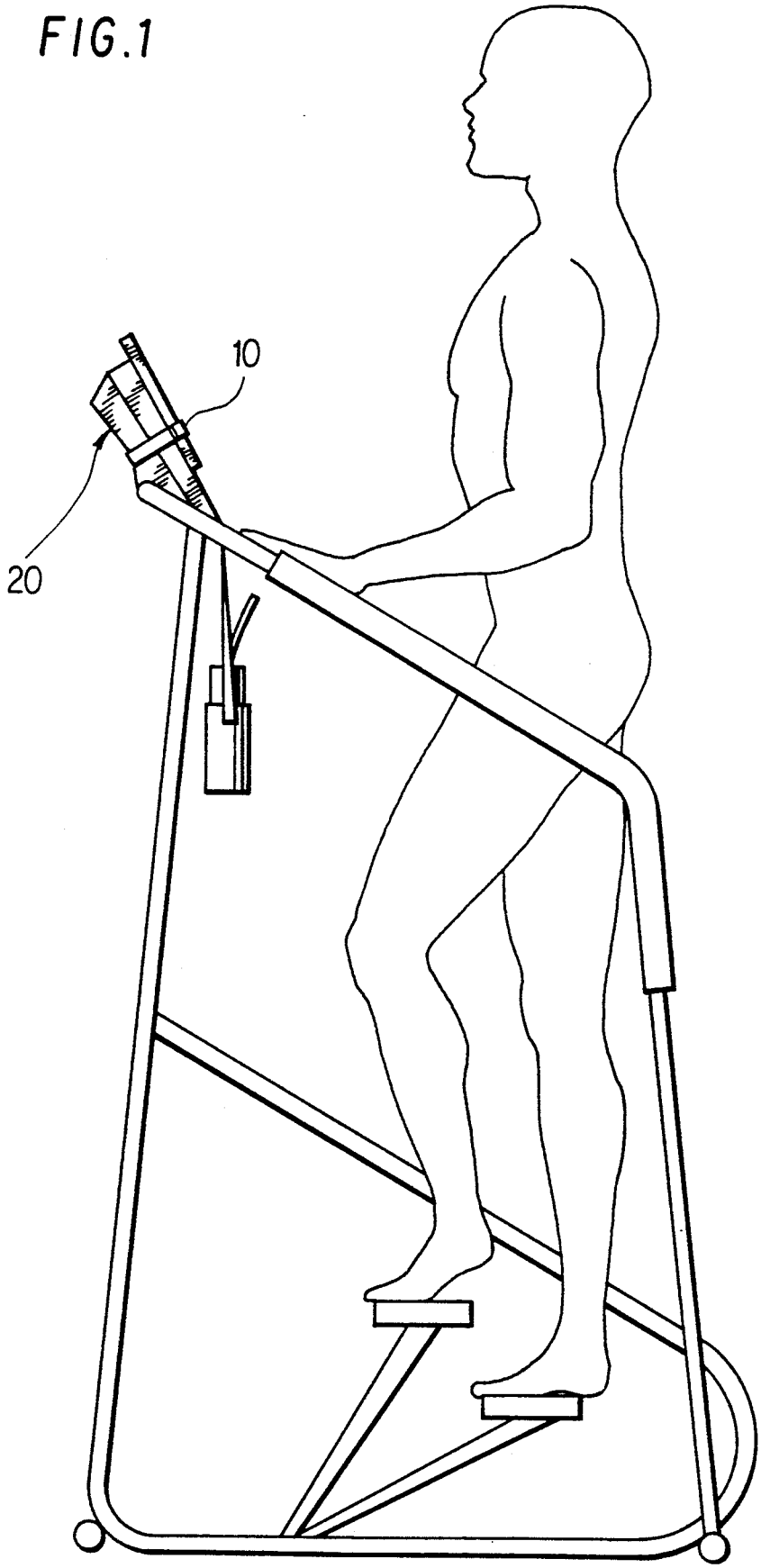
FIG. 1 is a side view of an exercise machine showing the exercise machine console area to which my Exercise Machine Carry-all is attached.

Referring now in particular to the accompanying drawings my Exercise Machine Carry-all is generally indicated in FIG. 1 at 10, wherein it is disposed around exercise machine console 20.

Figure 2:
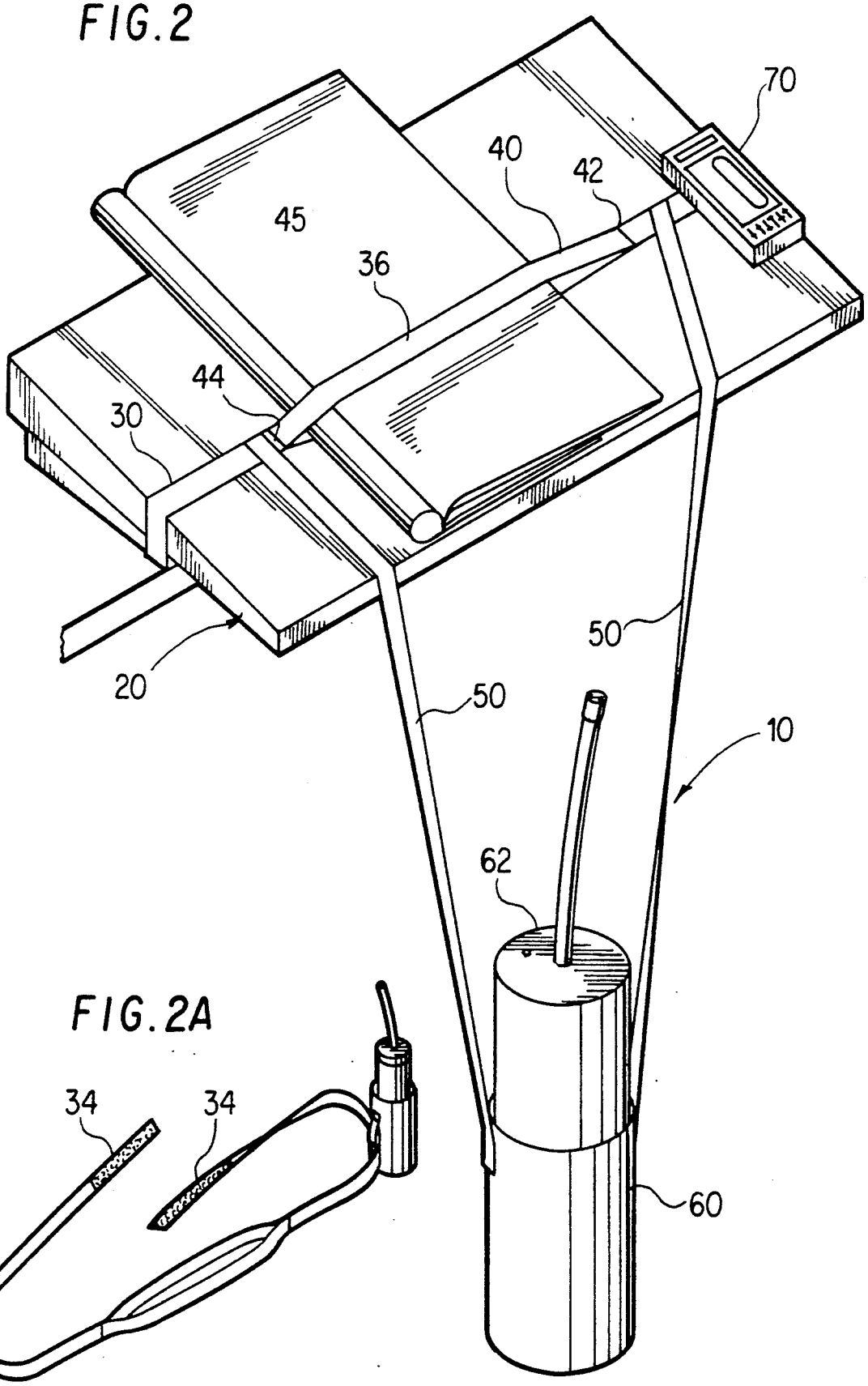
FIG. 2 is an isometric view of the exercise machine console area showing my invention disposed about said exercise machine console.
Figure 2A:
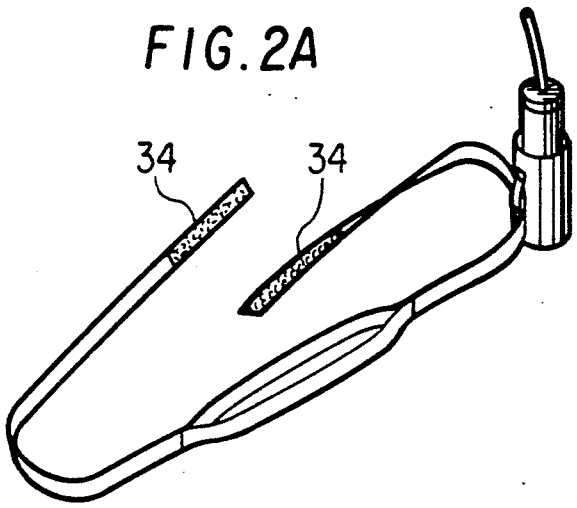
FIG. 2A is an isometric view of the middle section of the strap area showing detail of the double strap area.

FIG. 2 shows a more detailed perspective of the preferred embodiment. Strap 30 encircles the exercise machine console and is bound by fastening interlocking fastener straps 34 (FIG. 2A) in the back of the exercise machine console. A double strap 36, is sewn at ends 42, 44, to the first strap, forming an area to enclose a book 45., which can be retained in an open position. A second pair of straps 50, are attached to the first strap outside the double strap area and extend down to storage cup 60, into which a water bottle such as 62, may be inserted together with any valuables. A Walkman Radio 70, can also be clipped over onto the strap.

Typically in use the improved storage device is stretched over the exercise machine console and fastened by using the interlocking fastener straps to adjust for the difference in sizes of the exercise machine console. The downwardly extending straps go down to the storage cup into which a water bottle can be placed.

A book, open or closed, can be placed within the double strap area on the top of the exercise machine console. A Walkman radio can also be clipped onto the strap, as shown in FIG. 2.

In view of the foregoing disclosure, it is seen that certain specific advantages are obtained. The disclosure hereof is illustrative and is not intended to limit the scope of the invention.

Several modifications, changes and adaptions can be made by those skilled in the art without departing from the scope of the invention.

Therefore, different means may be substituted by other types of design and are anticipated by this invention.

Accordingly, it is the intention of the inventors to include all such modification which shall come within the true scope of the invention which is defined by the appendent claims.

What I claim is:

1. An Exercise Machine Carry-all for use in combination with an exercise machine console comprising in combination:

a. an exercising machine having a frame, said frame supporting a planar console;

b. first elasticized strap means releasably disposable around said exercise machine console;

c. second strap means attached at an upper end thereof to said first strap means and depending therefrom to a lower end thereof;

d. holder means attached to said lower end to said lower end of said strap means.

2. The Improved Storage Container of claim 1, wherein said first elasticized strap means further comprises:

(a) along a portion of said first elasticized strap means disposable about said exercise machine console, a second elasticized band means attached to said first elasticized strap means at at least two points along an upper surface of said exercise machine console.

3. The improved strap means of claim 1, wherein said holder means further comprises a substantially round hollow member, open at the top thereof so that a bottle of fluid may be placed therein.

4. The Improved Storage Container of claim 1, wherein said elasticized strap means further comprises:

(a) strap means having a textural surface thereof for holding slippery articles, or magazines, in position, and for retaining said articles clipped thereon.

5. The Improved Storage Container of claim 1, wherein said first elasticized strap means further comprises:

(a) attaching means at the ends thereof, permitting said strap means to be adjusted from a first position away from said exercise machine console to a second position closing engaging said exercise machine console.

6. The Improved Storage Container of claim 5, wherein said attaching means further comprise:

(a) extensible interlocking fastener means at the end thereof, in position to be adapted together to closely adapt to the surface of said exercise machine console.

* * * * *